US006682778B1

(12) United States Patent
Os

(10) Patent No.: US 6,682,778 B1
(45) Date of Patent: Jan. 27, 2004

(54) STENCIL TO PAD METHOD FOR APPLYING A COATING TO A PART

(75) Inventor: Arlen Van Os, Jenison, MI (US)

(73) Assignee: Van Os Enterprises, Jenison, MI (US)

( * ) Notice: Subject to any disclaimer, the term of this patent is extended or adjusted under 35 U.S.C. 154(b) by 177 days.

(21) Appl. No.: 09/827,790

(22) Filed: Apr. 6, 2001

Related U.S. Application Data

(60) Provisional application No. 60/194,937, filed on Apr. 6, 2000.

(51) Int. Cl.[7] ..... B05C 1/32

(52) U.S. Cl. ..... 427/282; 118/213; 118/261; 118/264; 118/406

(58) Field of Search ..... 118/213, 261, 118/406, 641–643, 264; 101/126, 127; 427/282; 92/223

(56) References Cited

U.S. PATENT DOCUMENTS 4,060,031 A 11/1977 Philipp ..... 101/163
4,628,857 A * 12/1986 Coningsby ..... 118/406
5,101,759 A * 4/1992 Hefele ..... 118/202
5,195,478 A 3/1993 Kawabata et al. ..... 123/193.4
5,266,142 A 11/1993 Penrice ..... 156/240
5,314,717 A 5/1994 Alt ..... 427/282
5,435,872 A 7/1995 Penrice ..... 156/240
5,941,160 A 8/1999 Kato et al. ..... 92/155
6,283,022 B1 * 9/2001 Kamen et al. ..... 101/129

* cited by examiner

*Primary Examiner*—Laura Edwards
(74) *Attorney, Agent, or Firm*—Young & Basile, P.C.

(57) ABSTRACT

An apparatus and method is disclosed for applying a coating of material to a predefined area on a surface of a part. A movable stencil is provided having a wall or surface with a predefined aperture corresponding to a pattern of the defined area to be coated. A wiper, such as a doctor blade or squeegee, is provided for filling the aperture with the coating of material to be applied to the part. A pad, preferably of silicon rubber, is provided for receiving the coating of material as the coating material passes through the aperture of the stencil and for applying the coating of material to the part in response to relative movement between the part and the pad.

30 Claims, 4 Drawing Sheets

STENCIL TO PAD METHOD FOR APPLYING A COATING TO A PART

CROSS-REFERENCE TO RELATED APPLICATIONS

This application is a continuation of provisional patent application Ser. No. 60/194,937 filed on Apr. 6, 2000.

FIELD OF THE INVENTION

The present invention relates to a method for applying a coating to a part, such as an anti-friction coating to a piston skirt, using a stencil to apply a predetermined thickness of the coating to a pad for subsequent application to the part surface.

BACKGROUND OF THE INVENTION

Current methods of coating the outer circumference of pistons include conventional pad printing, rotary pad printing, and direct screen printing. The purpose of the coating in the case of automotive skirt coatings is to eliminate scuffing in the skirt area of engine pistons while improving engine performance and reducing hydrocarbon emissions. Additionally, some pistons, such as air conditioner compressor pistons, use the anti-friction coating as a fluid seal. Bearings and shafts can also benefit from a coating as a result of the enhanced anti-friction and reduced wear characteristics imparted to a coated part.

Direct screen printing is widely used to coat pistons in the 5 micron to 40 micron range of thickness. The drawback in direct screen printing is that the sharp edges of the piston cut through the screen after approximately 5,000 to 10,000 impressions. Direct screen printing of the piston above approximately 45 microns results in an uneven texture produced by the necessarily wide diameter threads of the screen fabric.

Conventional pad printing and rotary pad printing, as disclosed in U.S. Pat. No. 5,266,142, are severely limited with respect to the thickness of coating that can be applied, typically less than 15 microns per pass, or requiring two passes for approximately 25 microns of thickness, due to the use of an etched cliché. The etched cliché does not transfer film thicknesses over 15 microns due to the high surface area and cohesion of the coating to the interior surface of the recess in the cliché. Additional passes of the pad increase coating time and slow down the coating process.

SUMMARY OF THE INVENTION

It is desirable in the present invention to provide a method and apparatus for applying a wide range of coating thicknesses from 5 microns to over 100 microns. It is desirable to provide a method and apparatus which can eliminate the problem associated with printing screens wearing out as a result of sharp edges of the part to be coated cutting through the screen. It is desirable in the present invention to provide precise control of the coating thickness being applied to the part. Increased speed of application, particularly of relatively thick coatings is also desirable. It is desirable in the present invention to reduce or eliminate the deformation associated with screens leading to inaccurate or unacceptable coating applications. It is desirable in the present invention to provide relatively thick coats without uneven or textured coating surfaces.

While the present invention will be described and illustrated with respect to a piston, it should be recognized that many parts can be advantageously coated with the apparatus and method according to the present invention including, but not limited to automotive and small engine pistons, two-cycle engine pistons, air compressor pistons, air conditioner compressor pistons, pump pistons, bearings, shafts, inside diameter of bearings, and parts having surfaces to be coated with geometry that is flat, conical, spherical sections, cylindrical sections, and both inside and outside diameters of rings. Generally, for illustration purposes of the present invention, a piston is described as having an aluminum casting with a machined outer diameter, however alternative metals may be used for the part to be coated without departing from the disclosure of the invention.

An apparatus according to the present invention applies a coating of material to a predefined area on a surface of a part. The apparatus comprises a movable stencil having a wall or surface with a predefined aperture corresponding to a pattern of the predefined area to be coated, a doctor blade or squeegee, generically referred to here as a wiper, fills the aperture through the stencil with the coating of material to be applied to the part, and a pad receives the coating of material passing through the aperture of the stencil for applying the coating of material to the part in response to relative movement between the part and the pad. A method according to the present invention is for applying a coating of material to a predefined area on a surface of a part and includes the steps of moving a stencil having a wall or surface with a predefined aperture corresponding to a pattern of the predefined area to be coated with respect to a pad, filling the aperture with the coating of material to be applied to the part with a doctor blade or squeegee, generically referred to here as a wiper, and receiving the coating of material passing through the aperture of the stencil on the pad and applying the coating of material to the part in response to relative movement between the part and the pad.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED AND ALTERNATIVE EMBODIMENTS

Figure 2:
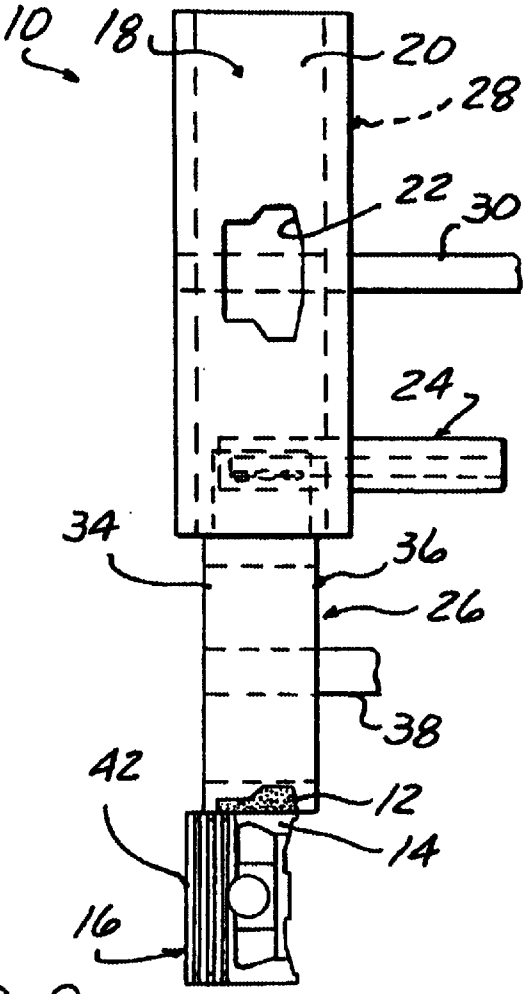
FIG. 2 is a side elevational view of the stencil for coating a part illustrated in FIG. 1.
Figure 1:
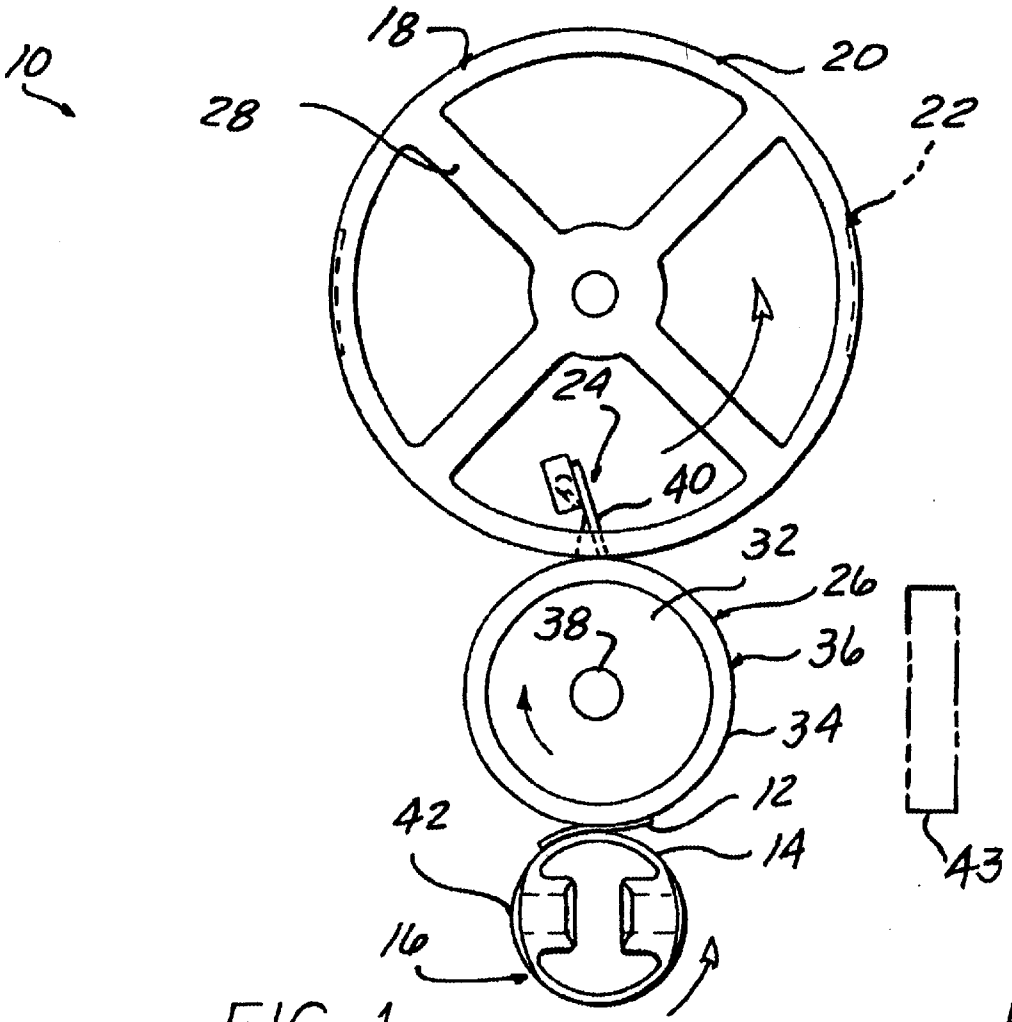
FIG. 1 is a front elevational view of a stencil for coating a part using rotary members according to the present invention.

Referring now to FIGS. 1 and 2, the apparatus 10 applies a coating of material 12 to a predefined area on a surface 14 of a part 16. A movable stencil 18 has a wall or surface 20 with a predefined aperture 22 corresponding to a pattern of the predefined area to be coated. A doctor blade or squeegee, generically referred to here as a wiper 24, fills the aperture 22 with the coating of material 12 to be applied to the part 16. A pad 26, preferably composed of silicon rubber, receives the coating material 12 passing through the aperture 22 of the stencil 18 as the wiper 24 fills the aperture 22, and applies the coating of material 12 to the part 16 in response to relative movement between the part 16 and the pad 26.

The stencil 18 can include a thin sheet or cylinder of stainless steel, or a woven or perforated screen, defining the wall or surface 20. The stencil 18 includes a cut-out aperture of the shape to be coated onto the part 16. The stencil 18 is attached to a wheel 28 in a spool configuration providing rigidity and supported for rotation with a centrally located combination of bearings and a drive shaft 30. A motor (not shown) is provided for controlled rotation of the wheel in response to control circuits or programs controlling the synchronized movement of the apparatus 10. The pad 26 preferably is a cylindrical metal core 32 covered with a layer of silicon rubber 34 forming a roller 36 mounted for controlled rotation on a centrally located combination of bearings and a drive shaft 38. Optionally, the pad can be in the form of an endless belt of predetermined length and width extending around two or more rollers. The drive shaft 38 can be driven by a servo motor, or by a transmission through gears, and/or pulleys, to provide the appropriate controlled rotational movement with respect to the wheel 28 and the part 16. The wiper 24 can be in the form of a doctor blade 40 providing a very straight, precise bar of metal or plastic that is attached to an adjustable slide (not shown), allowing adjustment of parallelism and pressure. Optionally, the doctor blade 40, or its support, may be hollow in order to form a tube for dispensing the coating material 12 inside or on top of the stencil 18. The part 16 can be in the form of a piston 42. The piston 42 can be formed as an aluminum casting with a machined outer diameter.

In operation, the stencil 18 is rotated in coordination with the pad 26 below. The coating material 12 accumulates against the stationary doctor blade 40. The doctor blade 40 fills and levels the coating of material 12 onto the pad 26 and stencil 18 at a thickness determined by the stencil thickness and doctor blade pressure. It is desirable to provide either a sufficient time delay, or to accelerate curing or drying of the coating of material 12 with various devices, to at least partial cure or to impart a tackiness to the coating of material 12 while on the pad 26 prior to transfer of the coating of material 12 to the part or piston 42. The process is adjusted as necessary depending on the curing or drying characteristics of the coating of material 12 and the production speed desired for the particular application. Forced or accelerated curing or drying devices 43 can include, by way of example and not limitation, forced air, conductive heat, convection heat, radiant heat, applied heat, reflective heat, microwave heat, ultraviolet light, infrared heat, chemical evaporation, chemical catalysts, chemical accelerating agents, chemical activator agents, and combinations thereof The stenciled area of the pad 26 comes into contact with the piston 42, turning at the same circumferential speed and aligned to the desired location for the coating of material 12. The coated piston is moved from the position illustrated when coating is completed, and replaced with an uncoated piston. The process is then repeated.

Figure 4:
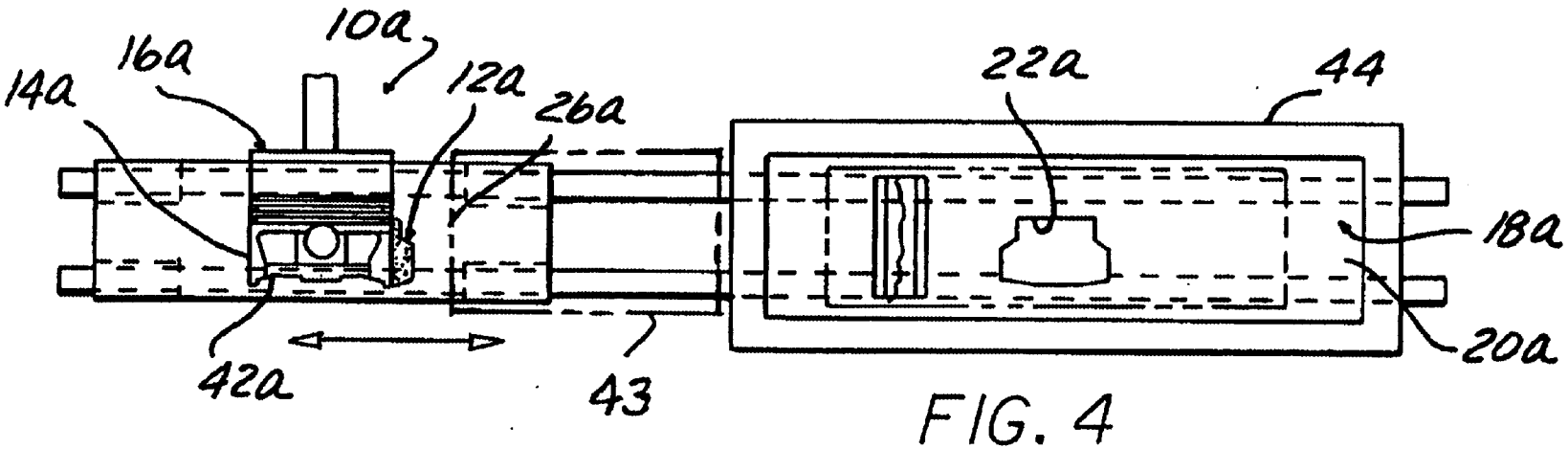
FIG. 4 is a plan view of the stencil for coating a part illustrated in FIG. 3.
Figure 3:
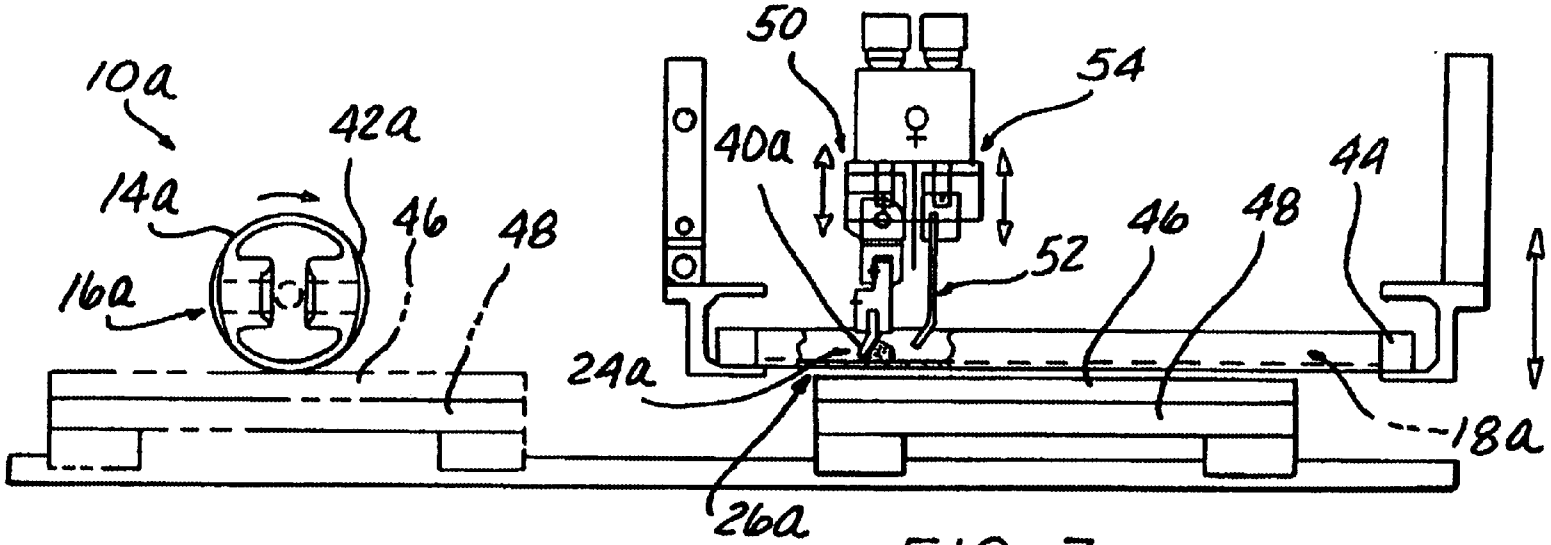
FIG. 3 is a front elevational view of a stencil for coating a part using linearly movable members according to the present invention.
Figure 5:
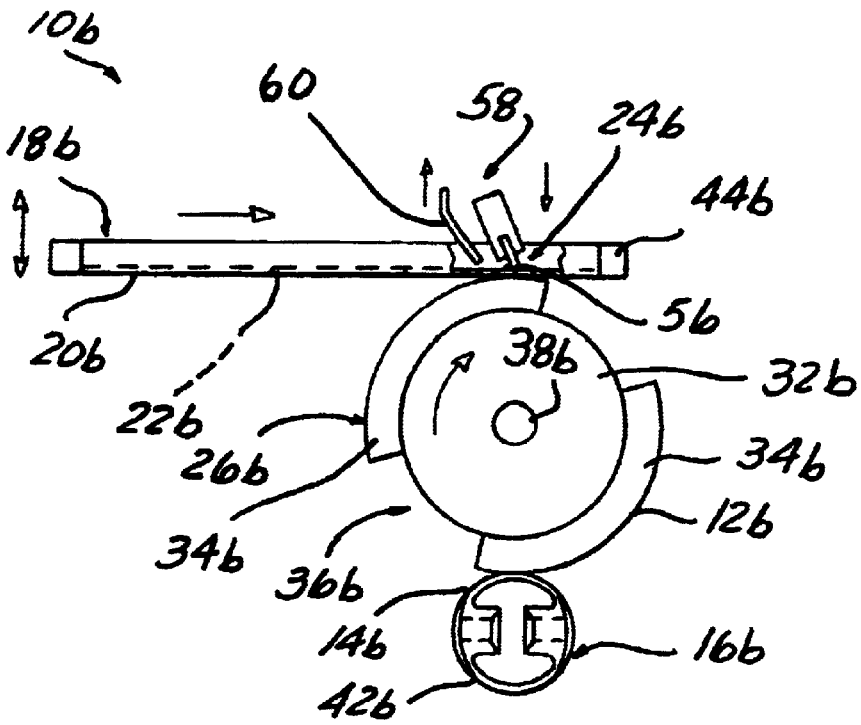
FIG. 5 is a front elevational view of a stencil for coating a part using a combination of rotary members and linearly moveable members illustrated in a first position.
Figure 6:
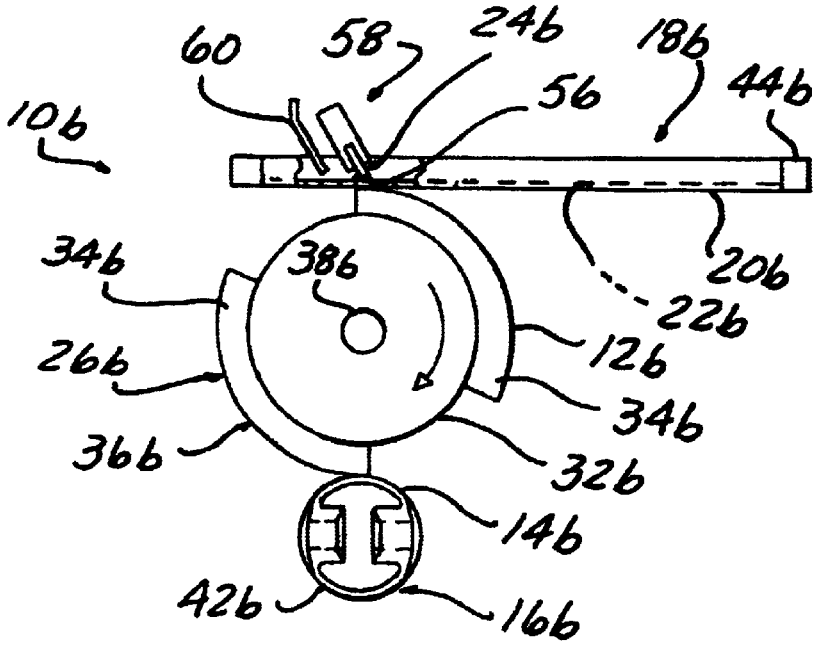
FIG. 6 is a front elevational view of the stencil, such as a linearly moveable screen, for applying a coating to a rotary member, such as a rotary pad, after moving to a second position.
Figure 7:
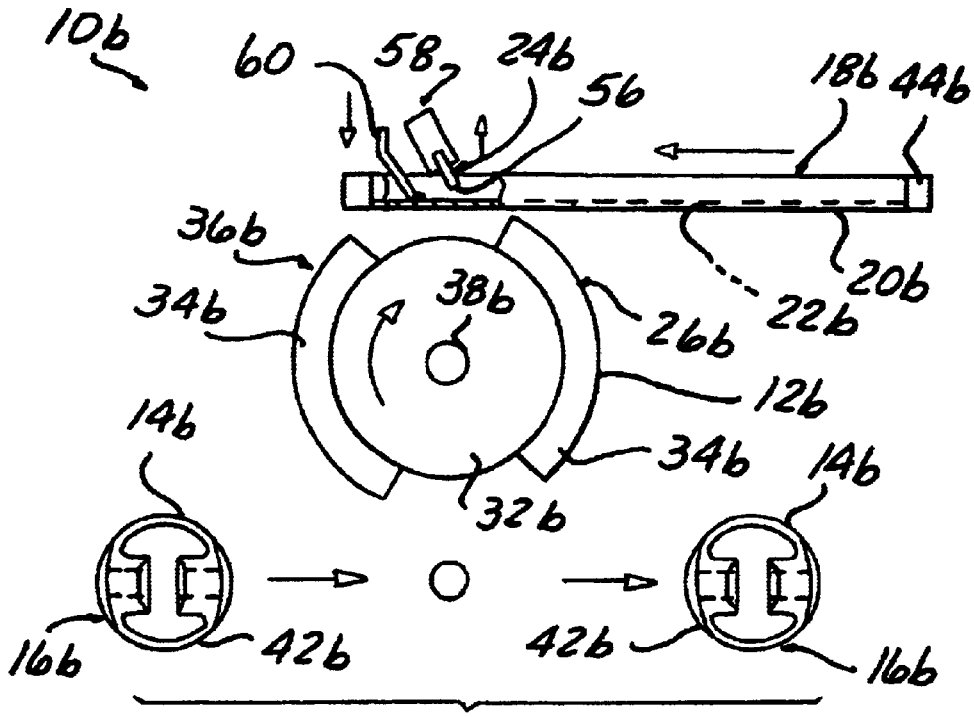
FIG. 7 is a front elevational view of the linear stencil to rotary pad coating apparatus after moving to a third position.
Figure 8:
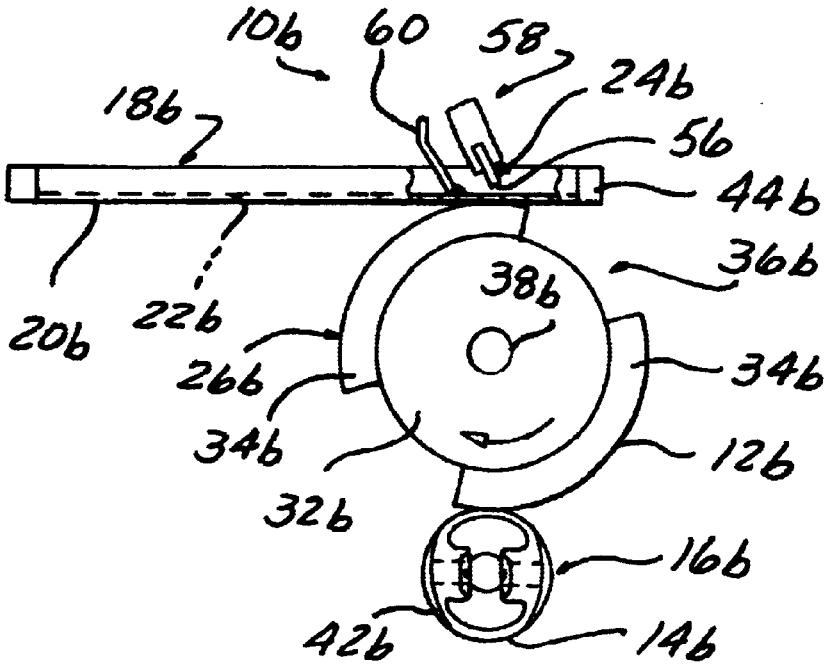
FIG. 8 is a front elevational view of the linear stencil to rotary pad coating apparatus after moving to a fourth position.

Referring now to FIGS. 3 and 4, an alternative apparatus **10*a* is provided for applying a coating of material 12*a* to a predefined area on a surface 14*a* of a part 16*a*. A movable stencil 18*a* includes a wall or surface 20*a* with a predefined aperture 22*a* corresponding to a pattern of the predefined area to be coated. A doctor blade or squeegee, generically referred to here as a wiper 24*a*, fills the aperture 22*a* with the coating of material 12*a* to be applied to the part 16*a*. A pad 26*a*, preferably of silicon rubber, receives the coating of material 12*a* passing through the aperture 22*a* of the stencil 18*a* and applies the coating of material 12*a* to the part 16*a* in response to relative movement between the part 16*a* and the pad 26*a***.

The stencil **18*a* can include a thin sheet of stainless steel, or woven screen, having a cut-out aperture 22*a* of the shape to be coated. The stencil 18*a* is fastened to a frame 44 providing rigidity and allowing mounting for reciprocal movement of the stencil 18*a* toward and away from the pad 26*a*. The pad 26*a* in this embodiment can be a flat layer 46 of silicon rubber adhered to a metal plate 48 for mounting. The wiper 24*a* can be attached to an adjustable slide 50 allowing adjustment of parallelism and pressure, while allowing the doctor blade 40*a* to alternately be lifted and lowered with respect to the stencil 18*a*. The doctor blade 40*a* is a very straight, precise bar of metal or plastic. A flood bar 52 can be provided and can include a bar of metal or a rubber blade attached to an adjustable slide 54 providing adjustment of parallelism and pressure, while allowing the flood bar 52 to be alternately lifted and lowered with respect to the stencil 18*a*. Alternatively, the flood bar 52 can be eliminated by using a doctor blade 40*a* as a flood bar on the return stroke. The part 16*a* can be in the form of a piston 42*a*. The piston 42*a*** is generally made as an aluminum casting with a machined outer diameter.

In operation, the stencil **18*a* is brought down into contact with the pad 26*a*. The flood bar 52 lowers and advances to the position shown covering the stencil 18*a* and pad 26*a* with a layer or coating of material 12. At this point in the cycle, the flood bar 52 is raised. The doctor blade 40*a* is then lowered and makes contact with the stencil 18*a*. The doctor blade 40*a* retracts to the right of the position illustrated, filling the stencil 18*a* and pad 26*a* at a thickness determined by the stencil thickness and doctor blade pressure. The stencil 18*a* is then raised from the position contacting the pad 26*a*. Optionally, the pad 26*a* is heated or warm air is blown onto the coated pad to partially dry the coating of material 12. The pad 26*a* then moves to the position shown in phantom at the left. As the pad 26*a* travels, the pad 26*a* comes in come contact with the lower tangent of the piston 42*a*. The piston circumference is rotated by a servo motor, or a rack and pinion, or a cable, or a chain drive at the same speed as the pad 26*a*. Alternatively, the piston 42*a* is rolled on the stationary pad 26*a*. When the pad 26*a* comes in contact with the piston 42*a* in the stenciled areas, the coating of material 12 will transfer to the piston 42*a*. The pad 26*a* is then returned to the original position on the right as illustrated in solid line in FIGS. 3 and 4**. The process is then repeated.

Referring now to FIGS. 5–8, a third embodiment according to the present invention is illustrated showing an apparatus **10*b* for applying a coating of material 12*b* to a predefined area on a surface 14*b* of a part 16*b*. The apparatus 10*b* includes a movable stencil 18*b* having a wall or surface 20*b* with a predefined aperture 22*b* corresponding to a pattern of the predefined area to be coated. A doctor blade or squeegee, generically referred to here as a wiper 24***b*, fills the aperture 22*b* with the coating of material 12*b* to be applied to the part 16*b*. A pad 26*b*, preferably of silicon rubber, receives the coating of material 12*b* passing through the aperture 22*b* of the stencil 18*b* and applies the coating of material 12*b* to the part 16*b* in response to relative movement between the part 16*b* and the pad 26*b*.

The stencil 18*b* can be in the form of a thin sheet of stainless steel, or a screen of woven material, such as fabric or wire, defining a wall or surface 20*b* with an aperture 22*b* in the shape to be coated. The stencil 18*b* is fastened to a frame 44*b* providing rigidity and mounted for reciprocal horizontal and vertical movement with respect to one or more pads 26*b*. The pad 26*b* can be in the form of a metal core 32*b* covered with a layer of silicon rubber 34*b* defining a roller 36*b*. The roller 36*b* is mounted for controlled rotation on a centrally located combination of bearings and a drive shaft 38*b*. The wiper 24*b* can be in the form of a squeegee 56 defined by a rubber blade attached to an adjustable slide 58 allowing adjustment of parallelism and pressure, while allowing alternate movement of the squeegee 56 to lift and lower and the squeegee 56 with respect to the stencil 18*b*. The part 16*b* can be in the form of a piston 42*b*. The piston 42*b* can be made of an aluminum casting with a machined outer surface.

In operation, the squeegee 56 and screen or stencil 18*b* is lowered into contact with the pad 26*b*. The pad 26*b* rotates in coordination with the travel of the screen or stencil 18*b*, while the screen or stencil 18*b* is printing on the pad 26*b*. The flood bar 60 is lowered. During the gap between stencil images, the screen or stencil 18*b* is returned to its original position flooding the screen with a coating of material 12*b*. As the piston 42*b* comes into contact with the pad 26*b* at the upper tangent, the coating of material 12*b* is transferred from the pad 26*b* to the piston 42*b*. The piston 42*b* is moved and replaced with an uncoated piston 42*b*. The process is then repeated.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for applying a coating of material to discontinuous cylindrical portions of a part comprising:

means for applying a coating of material onto an applicator surface, the applying means including at least one wall with an aperture extending therethrough allowing passage of the coating of material onto the applicator surface; and means for transferring the coating of material carried by the applicator surface to a surface of a part to be coated, the applicator surface movable synchronously with respect to the discontinuous cylindrical portions of the part to be coated in order to bring the coating of material into contact with the discontinuous cylindrical portions to be coated.

2. The apparatus of claim 1 further comprising:

means for at least partially curing the coating of material carried on the applicator surface.

3. The apparatus of claim 2 wherein the curing means is selected from a group consisting of forced air, conductive heating, convection heating, radiant heating, applied heating, reflective heating, microwave heating, ultraviolet light, infrared heating, chemical evaporation, chemical catalyst, chemical acceleration agent, chemical activator agent, and combinations thereof.

4. The apparatus of claim 1 wherein the applying means further comprises:

a rotatable wheel having a cylindrical wall with at least one aperture formed through the cylindrical wall.

5. The apparatus of claim 4 further comprising:

a wiper arm engageable with an interior surface of the cylindrical wall for spreading the coating of material to be applied through the at least one aperture.

6. The apparatus of claim 1 further comprising:

means for supplying the coating of material to the applying means.

7. The apparatus of claim 1 wherein the applicator surface further comprises:

a moveable surface engageable with the applying means at a receiving position and engageable with the part to be coated at a transferring position.

8. The apparatus of claim 7 further comprising:

a rotatable member supporting the applicator surface for movement along a fixed closed path of travel between the receiving position and the transferring position.

9. The apparatus of claim 1 wherein the transferring means further comprises:

a rotatable support member for holding a part to be coated and for synchronously rotatably engaging a surface of the part to be coated with the applicator surface.

10. The apparatus of claim 1 further comprising a source of material to be coated on the part, wherein the coating of material to be applied is a low friction material.

11. The apparatus of claim 1 further comprising means for synchronously moving the part to be coated with respect to the applicator surface, wherein the part to be coated is a piston.

12. An apparatus for applying a coating of material to discontinuous cylindrical portions of a part comprising:

a rotatable wheel having a cylindrical wall with at least one aperture extending therethrough for applying a coating of material onto an applicator surface; and a rotatable support member for holding a part to be coated and for transferring the coating of material carried by the applicator surface to a surface of the part to be coated, the applicator surface movable synchronously with respect to the discontinuous cylindrical portions of the part to be coated in order to bring the coating of material into contact with the discontinuous cylindrical portions to be coated.

13. The apparatus of claim 12 further comprising:

means for at least partially curing the coating of material carried on the applicator surface.

14. The apparatus of claim 13 wherein the curing means is selected from a group consisting of forced air, conductive heating, convection heating, radiant heating, applied heating, reflective heating, microwave heating, ultraviolet light, infrared heating, chemical evaporation, chemical catalyst, chemical acceleration agent, chemical activator agent, and combinations thereof.

15. The apparatus of claim 12 further comprising:

a wiper arm engageable with an interior surface of the cylindrical wall for spreading the coating of material to be applied through the at least one aperture.

16. The apparatus of claim 12 wherein the applicator surface further comprises:

a moveable surface engageable with the applying means at a receiving position and engageable with the part to be coated at a transferring position.

17. The apparatus of claim 16 further comprising:

a rotatable member supporting the applicator surface for movement along a fixed closed path of travel between the receiving position and the transferring position.

18. The apparatus of claim 12 further comprising a source of material to be coated on the part, wherein the coating of material to be applied is a low friction material.

19. The apparatus of claim 12 further comprising means for synchronously moving the part to be coated with respect to the applicator surface, wherein the part to be coated is a piston.

20. A method for applying a coating of material to discontinuous cylindrical portions of a part comprising the steps of:

applying a coating of material onto an applicator surface through an aperture extending through at least one wall allowing passage of the coating material onto the applicator surface; and transferring the coating of material carried by the applicator surface to a surface of a part to be coated as the applicator surface moves synchronously with is respect to the discontinuous cylindrical portions of the part to be coated in order to bring the coating of material into contact with the discontinuous cylindrical portions to be coated.

21. The method of claim 20 further comprising the steps of:

at least partially curing the coating of material carried on the applicator surface.

22. The method of claim 21 wherein the curing step is selected from a group consisting of blowing forced air, conductive heating, convection heating, radiant heating, applied heating, reflective heating, microwave heating, ultraviolet light heating, infrared heating, chemical evaporation, chemical catalyst reacting, chemical accelerating agent, chemical activating agent, and combinations thereof.

23. The method of claim 20 wherein the applying step further comprises the step of:

rotating a wheel having a cylindrical wall with at least one aperture formed through the cylindrical wall.

24. The method of claim 23 further comprising the step of:

engaging a wiper arm with an interior surface of the cylindrical wall for spreading the coating of material to be applied through the at least one aperture.

25. The method of claim 20 further comprising the step of: supplying the coating of material to be applied to the applicator surface.

26. The method of claim 20 wherein the applicator surface further comprises:

a moveable surface engageable with the applying means at a receiving position and engageable with the part to be coated at a transferring position.

27. The method of claim 26 further comprising the step of:

moving the applicator surface along a fixed closed path of travel between the receiving position and the transferring position with a rotatable member.

28. The method of claim 20 wherein the transferring step further comprises the step of:

holding a part to be coated with a rotatable support member; and synchronously rotatably engaging a surface of the part to be coated with the applicator surface.

29. The method of claim 20 further comprising the step of supplying material to be coated on the applicator surface, wherein the coating of material to be applied is a low friction material.

30. The method of claim 20 further comprising the step of synchronously moving the applicator surface with respect to the discontinuous cylindrical portions of the part to be coated, wherein the part to be coated is a piston.

* * * * *